US011566516B2

(12) United States Patent
Brown

(10) Patent No.: US 11,566,516 B2
(45) Date of Patent: Jan. 31, 2023

(54) INDEXING VALVE SYSTEM FOR A RESOURCE EXPLORATION AND RECOVERY SYSTEM

(71) Applicant: Donavan Holland Brown, Houston, TX (US)

(72) Inventor: Donavan Holland Brown, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 281 days.

(21) Appl. No.: 16/865,505

(22) Filed: May 4, 2020

(65) Prior Publication Data

US 2021/0340863 A1 Nov. 4, 2021

(51) Int. Cl.

| | |
|---|---|
| ***E21B 47/12*** | (2012.01) |
| ***E21B 23/03*** | (2006.01) |
| *E21B 34/06* | (2006.01) |

(52) U.S. Cl.
CPC ..... *E21B 47/12* (2013.01); *E21B 23/03* (2013.01); *E21B 34/066* (2013.01)

(58) Field of Classification Search
CPC ..... E21B 34/066; E21B 23/03; E21B 47/12
See application file for complete search history.

(56) References Cited

U.S. PATENT DOCUMENTS

| | | | | |
|---|---|---|---|---|
| 5,901,796 | A | 5/1999 | McDonald | |
| 8,893,805 | B2 | 11/2014 | McGarian | |
| 2004/0007356 | A1* | 1/2004 | Myron | E21B 23/006 166/240 |
| 2009/0126936 | A1 | 5/2009 | Begley et al. | |
| 2010/0193196 | A1* | 8/2010 | McGarian | E21B 23/004 166/373 |
| 2016/0177669 | A1* | 6/2016 | Avant | E21B 34/10 166/331 |
| 2018/0283122 | A1* | 10/2018 | Campbell | E21B 31/005 |

FOREIGN PATENT DOCUMENTS

| | | | |
|---|---|---|---|
| CN | 103982167 | A | 8/2014 |

OTHER PUBLICATIONS

International Search Report and Written Opinion for International Application No. PCT/US2021/026810; International Filing Date Apr. 12, 2021; Report dated Jul. 28, 2021 (pp. 1-10).

* cited by examiner

*Primary Examiner* — Christopher J Sebesta
(74) *Attorney, Agent, or Firm* — Cantor Colburn LLP

(57) ABSTRACT

An indexing valve system includes a first tubular having an outer surface portion, an inner surface portion defining a passage portion, and a plurality of indexing components. A second tubular is axially aligned with the first tubular. The second tubular includes an outer surface section, an inner surface section defining a passage section, and a plurality of indexing members that selectively inter-engage with the plurality of indexing components. The inner surface section including a plurality of indexing elements. An insert extends into, and is axially shiftable relative to, the passage portion and the passage section. The insert includes an outer surface supporting an indexer that selectively engages with the plurality of indexing elements to rotate the second tubular relative to the first tubular.

17 Claims, 12 Drawing Sheets

INDEXING VALVE SYSTEM FOR A RESOURCE EXPLORATION AND RECOVERY SYSTEM

BACKGROUND

In the resource exploration and recovery industry, boreholes may be formed in a resource bearing formation. A casing may be extended into the resource bearing formation. A tubular may then be extended into the casing. The resource bearing formation may include various zones of interest. Seals or packers may be deployed from the tubular outwardly against the casing to isolate one zone of interest from another. At this point, the casing may be selectively perforated in order to introduce fluids from the tubular into the formation or vice-versa.

Treatment fluids may flow into the formation through valves provided in the tubular. Similarly, valves may be selectively positioned to allow formation fluids to pass into the tubular from the formation. There are various actuation mechanisms for operating downhole valves. One system involves the use of a pin and j-slot assembly. The pin and j-slot assembly relies on the use of multiple separate and distinct components including a j-sleeve and a bearing sleeve internal to a valve's housing to provide a j-slot track that facilitates movement between valve positions. The multiple separate and distinct components add to an overall cost and complexity of the actuation mechanism. Further, the use of j-slot tracks imposes a length requirement on the valve. The art would be appreciative of a valve having fewer components and may be made without j-tracks and thus allow for the construction of a more compact valve.

SUMMARY

Disclosed is an indexing valve system including a first tubular having an outer surface portion, an inner surface portion defining a passage portion, and a plurality of indexing components. A second tubular is axially aligned with the first tubular. The second tubular includes an outer surface section, an inner surface section defining a passage section, and a plurality of indexing members that selectively inter-engage with the plurality of indexing components. The inner surface section including a plurality of indexing elements. An insert extends into, and is axially shiftable relative to, the passage portion and the passage section. The insert includes an outer surface supporting an indexer that selectively engages with the plurality of indexing elements to rotate the second tubular relative to the first tubular.

Also disclosed is a resource exploration and recovery system including a first system and a second system including at least one tubular extending from the first system into a formation. The second system includes an indexing valve system fluidically connected to the at least one tubular. The indexing valve system includes a first tubular including an outer surface portion, an inner surface portion defining a passage portion, and a plurality of indexing components. A second tubular is axially aligned with the first tubular. The second tubular includes an outer surface section, an inner surface section defining a passage section, and a plurality of indexing members that selectively inter-engage with the plurality of indexing components. The inner surface section includes a plurality of indexing elements. An insert extends into, and is axially shiftable relative to, the passage portion and the passage section. The insert includes an outer surface supporting an indexer that selectively engages with the plurality of indexing elements to rotate the second tubular relative to the first tubular.

Further disclosed is a method of operating an indexing valve system including shifting an insert into a passage section of a tubular, engaging an indexer on the insert with one of a plurality of indexing elements provided on the tubular, further shifting the insert to unseat a plurality of indexing members on the tubular from a plurality of indexing components on another tubular, rotating the tubular a first distance through inter-engagement of the indexer and the one of the plurality of indexing elements, biasing the tubular back toward the another tubular, re-engaging the plurality of indexing members with the plurality of indexing components, and rotating the tubular a second distance by re-engaging the plurality of indexing members with the plurality of indexing components.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
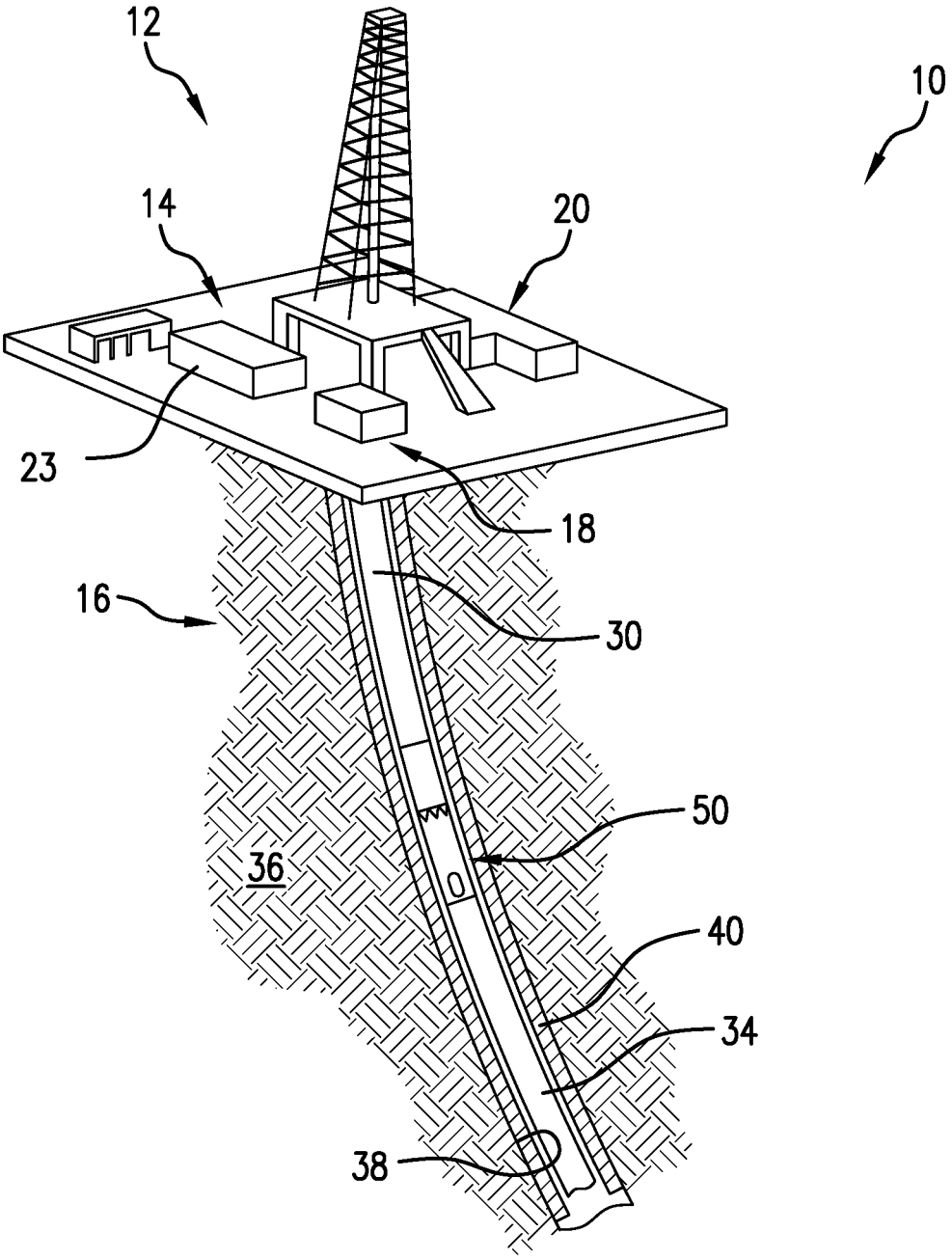
FIG. 1 depicts a resource exploration and recovery system including an indexing valve system, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from one or more tubulars (not separately labeled) that is extended into a wellbore 34 formed in formation 36. Wellbore 34 includes an annular wall 38 that may be defined by a casing tubular 40 that extends from first system 12 into second system 16.

Figure 2:
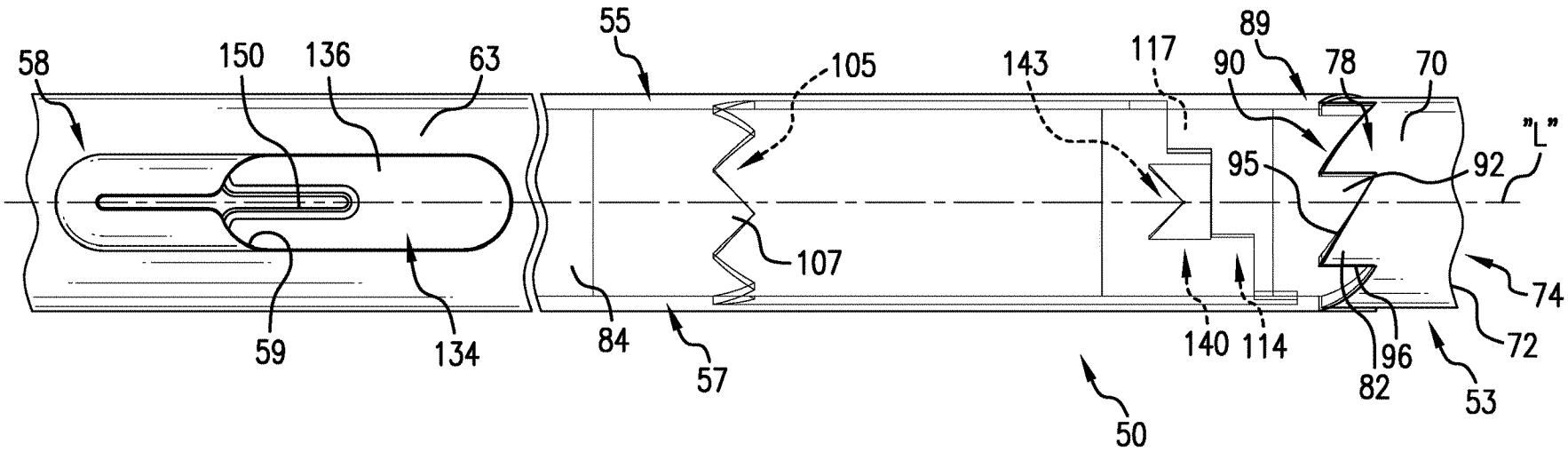
FIG. 2 depicts a glass view of the indexing valve system, in accordance with an exemplary aspect.
Figure 3:
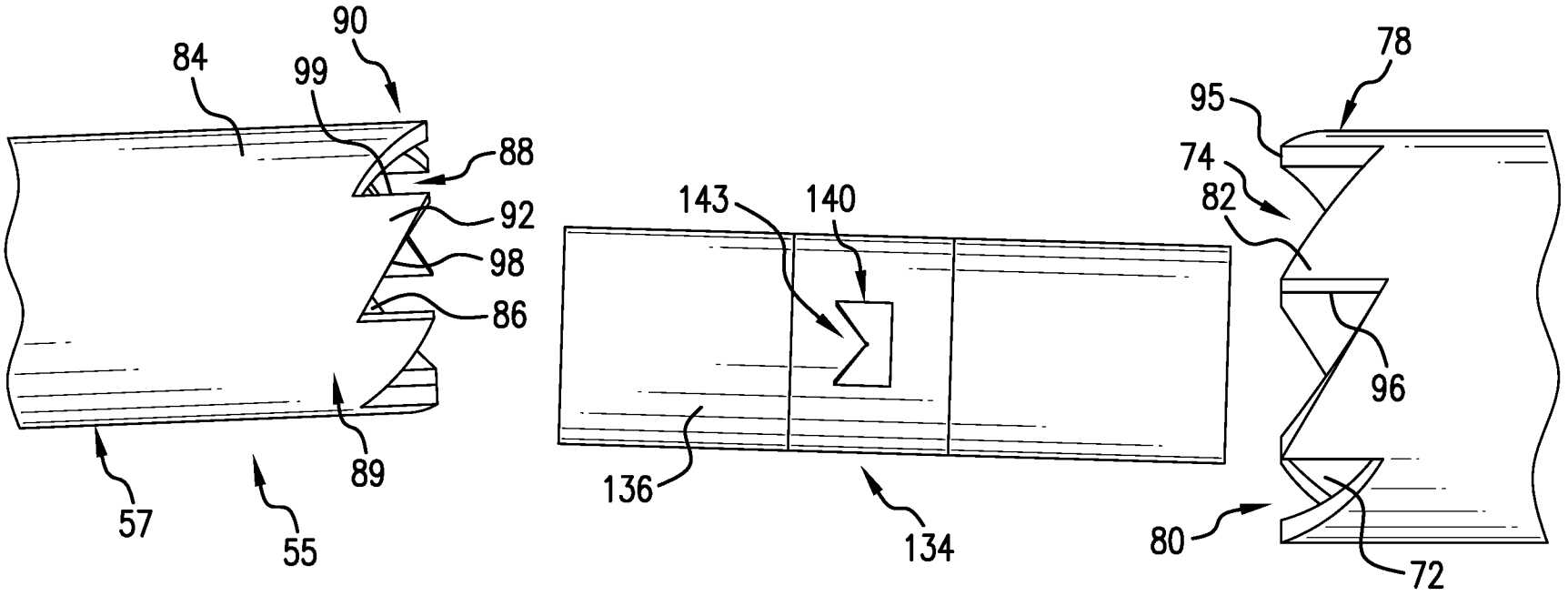
FIG. 3 depicts a dissembled view of a portion of the indexing valve system, in accordance with an exemplary aspect.
Figure 4:
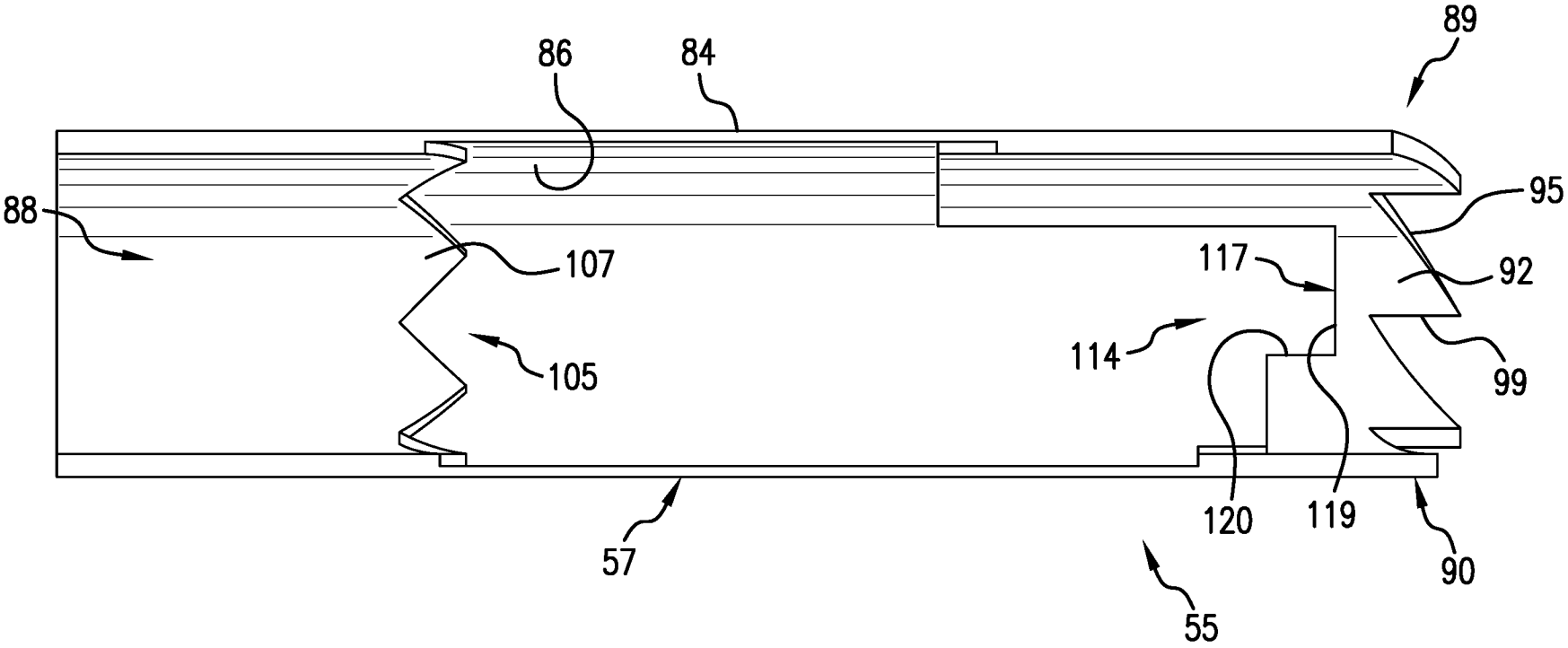
FIG. 4 depicts a cross-sectional view of a valve member of the indexing valve system, in accordance with an exemplary aspect.

In accordance with an exemplary aspect, tubulars 30 support an indexing valve assembly 50. Referring to FIGS. 2-4, indexing valve assembly 50 includes a first tubular 53 and a second tubular 55 that takes the form of a valve member 57. First tubular 53 includes a flow port 58, shown in the form of an opening 59. In an embodiment, opening 59 is a non-circular elongated opening having varying dimensions. First tubular 53 and second tubular 55 extend along a longitudinal axis "L". First tubular 53 includes an outer surface portion 70 and an inner surface portion 72 that defines a passage portion 74. First tubular 53 includes a terminal end portion 78 having a plurality of indexing components 80. Indexing components 80 may take the form of an annular array of tooth components 82.

Second tubular 55 includes an outer surface section 84 and an inner surface section 86 that defines a passage section 88. Second tubular 55 includes a terminal end section 89 having a plurality of indexing members 90. Indexing members 90 may take the form of an annular array of tooth members 92. In an embodiment, each of the plurality of tooth components 80 on first tubular 53 includes a first surface portion 95 that extends at an angle relative to longitudinal axis "L" and a second surface portion 96 that is aligned with longitudinal axis "L". Similarly, each of the plurality of tooth members 92 on second tubular 55 includes a first surface section 98 that extends at an angle relative to longitudinal axis "L" and a second surface section 99 that is aligned with longitudinal axis "L". As will be detailed herein, interaction between the tooth components 80 and tooth members 92 results in a ratcheting rotation of second tubular 55.

In accordance with an exemplary aspect, second tubular 55 includes a plurality of indexing elements 105 that project radially inwardly and proud of inner surface section 86. Indexing elements 105 may take the form of an annular array of sawtooth elements 107. Each sawtooth element 107 includes first and second saw tooth sides (not separately labeled) that extend at an angle relative to longitudinal axis "L" Second tubular 55 also includes a travel limiter 114 that may take the form of one or more step features 117 that project radially inwardly from and proud of inner surface section 86. Each step feature 117 includes a first surface 119 that extends perpendicularly relative to longitudinal axis "L" and a second surface 120 that extends parallel to longitudinal axis "L". As will be detailed herein, travel limiter 114 restricts axial travel of an insert 134 that extends through passage portion 74 and passage section 88.

In an embodiment, insert 134 includes an outer surface 136 that supports an indexer 140. Indexer 140 projects radially proudly or outwardly of outer surface 136. Indexer 140 includes a tooth receiver 143 that includes first and second angled surfaces (not separately labeled) that correspond to the first and second sawtooth sides (also not separately labeled) of indexing elements 105. As will be detailed herein, insert 134 is shifted axially within first and second tubulars 53 and 55 to cause second tubular 55 to rotate relative to first tubular 53. Insert may be shifted through various mechanisms including, but not limited to, a shifting tool, application of tubular pressure, application of annular pressure and the like. Insert 134 includes an opening 150 that selectively registers with opening 59 in first tubular 53. In an embodiment, opening 150 is an elongated non-circular opening having varying dimensions. Shifting insert 134 establishes a selected degree of registration of opening 150 and opening 59 to create a desired flow rate. Thus, in the position shown in FIG. 2, only a portion of opening 150 is exposed to opening 59.

Figure 5:
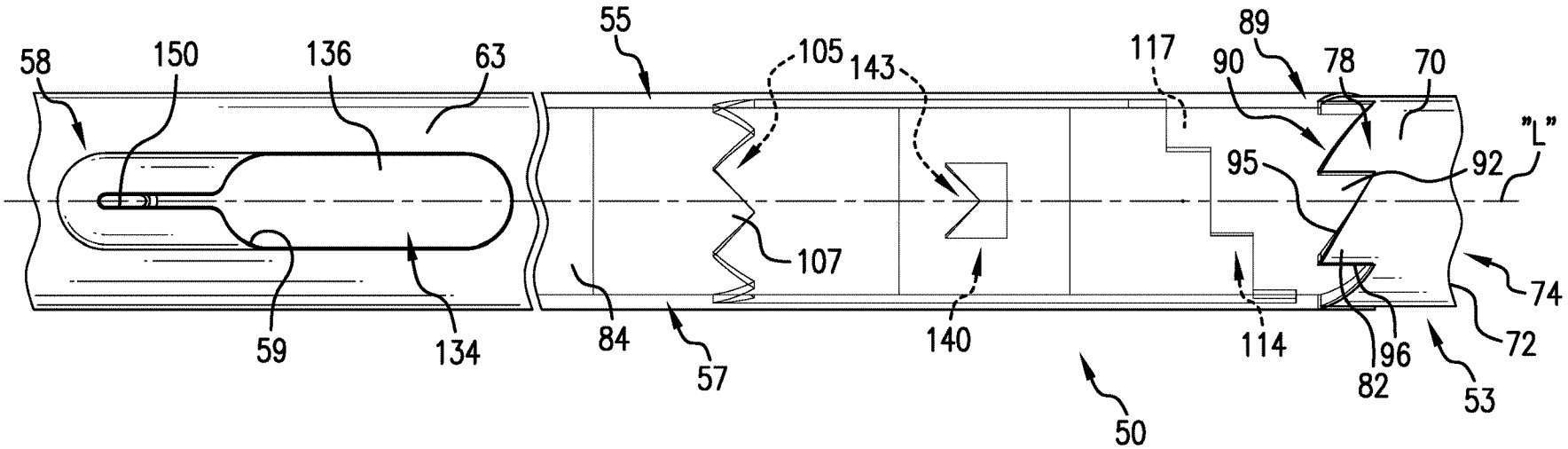
FIG. 5 depicts an insert shifting an indexer toward a plurality of indexing elements arranged on an inner surface of the valve member, in accordance with an exemplary aspect.
Figure 6:
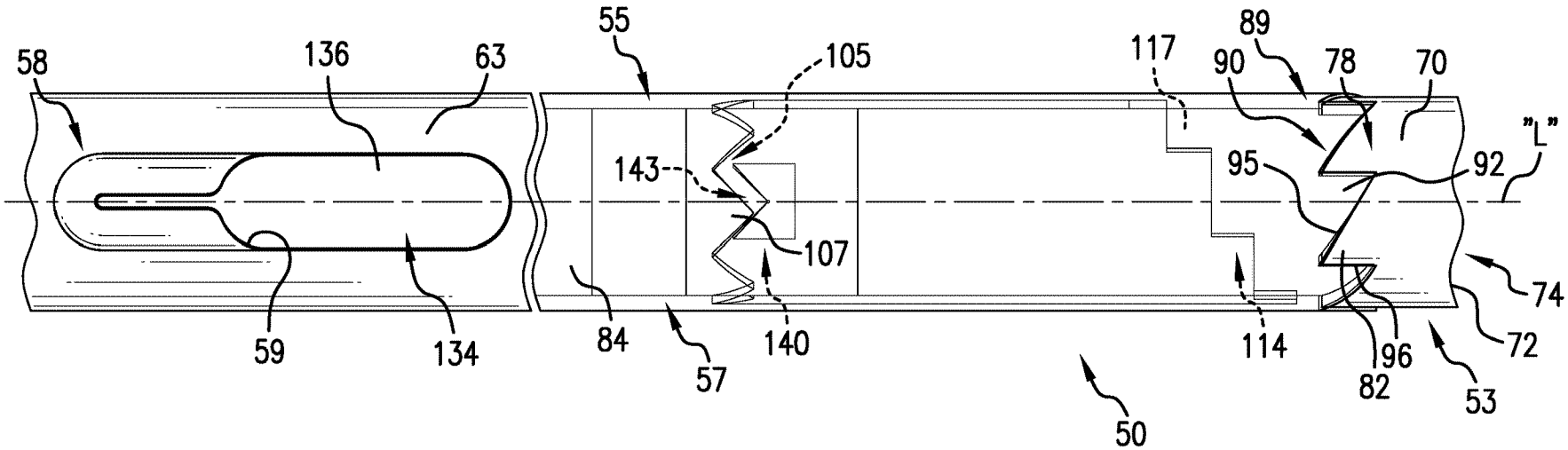
FIG. 6 depicts the indexer engaging with one of the plurality of indexing elements, in accordance with an exemplary aspect.
Figure 7:
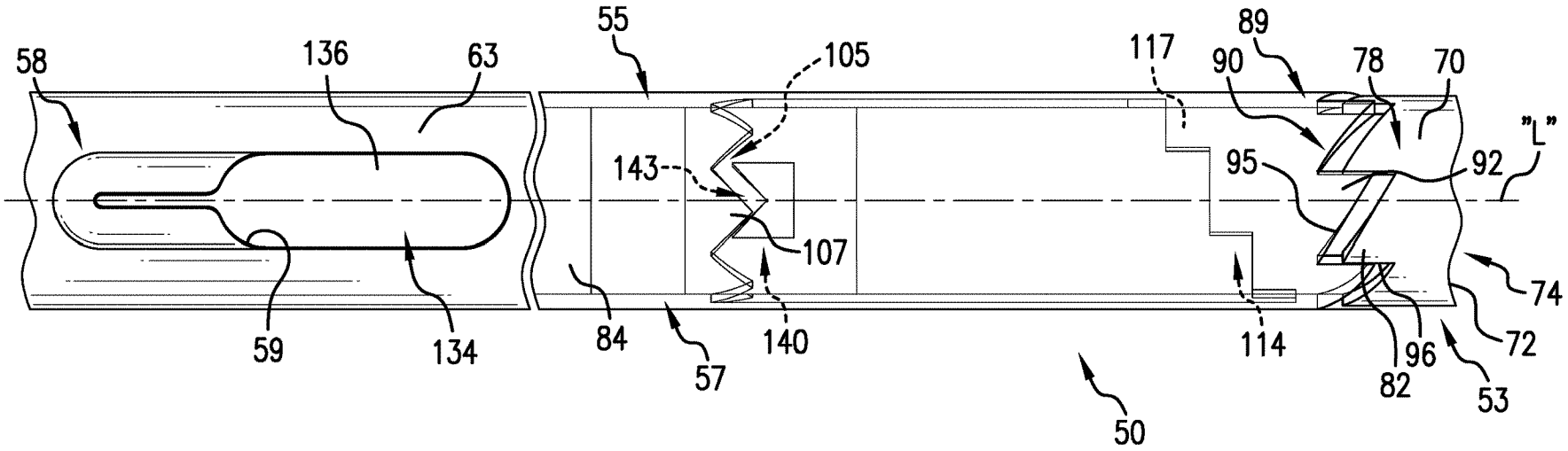
FIG. 7 depicts the insert unseating the valve member from a first tubular disengaging a plurality of indexing members from a plurality of indexing components, in accordance with an exemplary aspect.

As shown in FIG. 5, insert 134 is shifted into passage section 88 causing indexer 140 to move toward indexing elements 105. Insert 134 continues to shift until one of the annular array of sawtooth elements 107 passes into tooth receiver 143. One of the sawtooth sides contacts one of the angled sides of tooth receiver 143 as shown in FIG. 6. Insert 134 is further shifted causing the plurality of indexing members 90 to disengage from the plurality of indexing components 80 on first tubular 53 as shown in FIG. 7.

Figure 8:
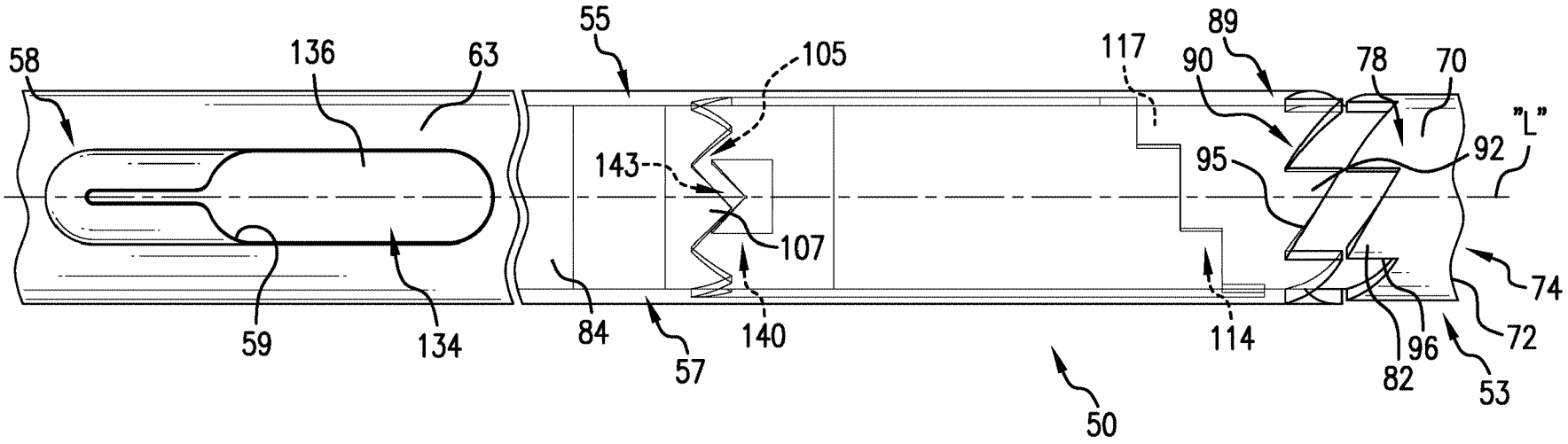
FIG. 8 depicts the indexer moving along one of the plurality of indexing members causing the valve member to begin to rotate relative to the first tubular, in accordance with an exemplary aspect.
Figure 9:
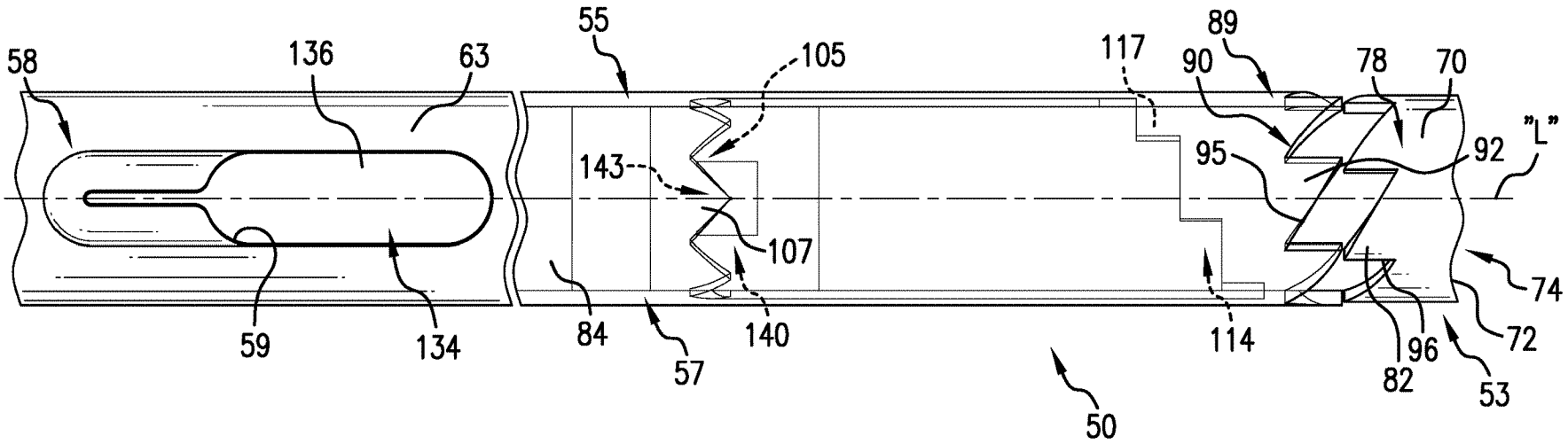
FIG. 9 depicts the valve member rotated a first distance relative to the first tubular, in accordance with an exemplary aspect.
Figure 10:
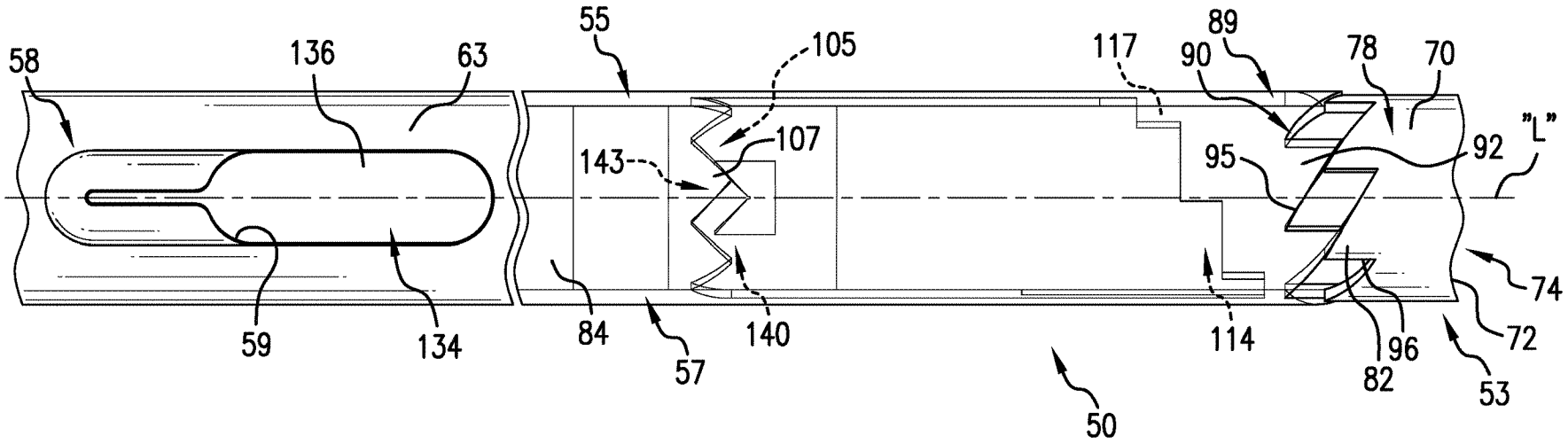
FIG. 10 depicts the indexer disengaging from the one of the plurality of indexing elements allowing the plurality of indexing members to begin to re-engage with the plurality of indexing components, in accordance with an exemplary aspect.

Once the plurality of indexing members 90 completely separate from the plurality of indexing components 80 through further shifting of insert 134 as shown in FIG. 8, second tubular 55 may rotate a first distance as shown in FIG. 9. At this point, insert 134 has shifted such that no portion of opening 150 is exposed to opening 59. After rotation of the first distance, one of the annular array of sawtooth elements 107 is fully nested in tooth receiver 143 completing a first portion of rotation of second tubular 55. At this point, insert 134 may be shifted in an opposite direction (into passage portion 74) allowing a spring (not shown) to bias second tubular 55 back toward first tubular 53 as shown in FIG. 10. At this point, it should be understood that while described as employing a spring to return second tubular 55 toward first tubular 53, other mechanisms may be employed.

Figure 11:
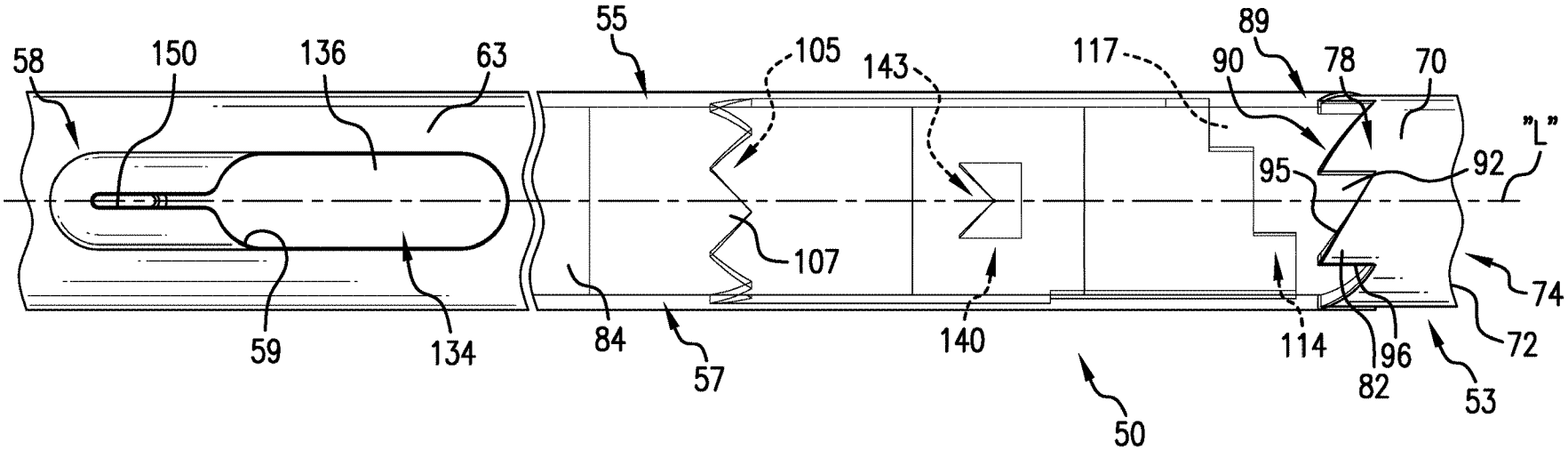
FIG. 11 depicts the indexing member shifting further away from the plurality of indexing elements, in accordance with an exemplar aspect.
Figure 12:
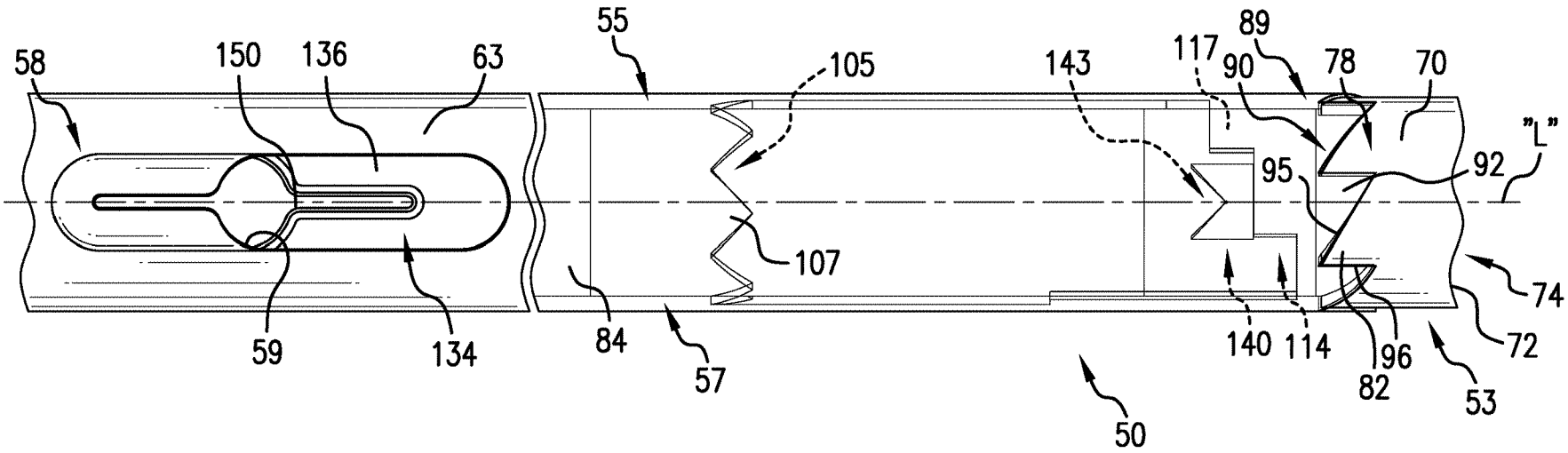
FIG. 12 depicts the plurality of indexing member re-engaged with the plurality of indexing components to complete rotation of the valve member a second distance, in accordance with an exemplary aspect.

At this point, the plurality of indexing members 90 re-engage with the plurality of indexing components 80 causing second tubular 55 to rotate a second distance. Rotation of second tubular 55 completes when the plurality of indexing members 90 fully reengage with the plurality of indexing components 80 as shown in FIG. 11. At this point, a greater portion of opening 150 is exposed to opening 59. The rotation of second tubular 55 may be employed to change/adjust a degree of opening of flow port 58 to establish a desired flow restriction or flow rate.

Set forth below are some embodiments of the foregoing disclosure:

Embodiment 1. An indexing valve system comprising: a first tubular including an outer surface portion, an inner surface portion defining a passage portion, and a plurality of indexing components; a second tubular axially aligned with the first tubular, the second tubular including an outer surface section, an inner surface section defining a passage section, and a plurality of indexing members that selectively inter-engage with the plurality of indexing components, the inner surface section including a plurality of indexing elements; and an insert extending into, and being axially shiftable relative to, the passage portion and the passage section, the insert including an outer surface supporting an indexer that selectively engages with the plurality of indexing elements to rotate the second tubular relative to the first tubular.

Embodiment 2. The indexing valve system according to any prior embodiment, wherein the first tubular includes a terminal end portion, the plurality of indexing components being formed in the terminal end portion.

Embodiment 3. The indexing valve system according to any prior embodiment, wherein the plurality of indexing components include an annular array of tooth components.

Embodiment 4. The indexing valve system according to any prior embodiment, wherein the second tubular includes a terminal end section, the plurality indexing members being arranged on the terminal end section.

Embodiment 5. The indexing valve system according to any prior embodiment, wherein the plurality of indexing elements project radially inwardly from the inner surface section.

Embodiment 6. The indexing valve system according to any prior embodiment, wherein the indexer projects radially outwardly of the outer surface, the indexer including a receiving portion that is selectively receptive of one of the plurality of indexing elements.

Embodiment 7. The indexing valve system according to any prior embodiment, further comprising: a travel limiter provided in the inner surface section, the travel limiter restricting axial travel of the insert relative to the first and second tubulars.

Embodiment 8. The indexing valve system according to any prior embodiment, wherein the travel limiter comprises a plurality of step features that extend radially inwardly of and annularly about the inner surface section.

Embodiment 9. A resource exploration and recovery system comprising: a first system; a second system including at least one tubular extending from the first system into a formation, the second system including an indexing valve system fluidically connected to the at least one tubular, the indexing valve system comprising: a first tubular including an outer surface portion, an inner surface portion defining a passage portion, and a plurality of indexing components; a second tubular axially aligned with the first tubular, the second tubular including an outer surface section, an inner surface section defining a passage section, and a plurality of indexing members that selectively inter-engage with the plurality of indexing components, the inner surface section including a plurality of indexing elements; and an insert extending into, and being axially shiftable relative to, the passage portion and the passage section, the insert including an outer surface supporting an indexer that selectively engages with the plurality of indexing elements to rotate the second tubular relative to the first tubular.

Embodiment 10. The indexing valve system according to any prior embodiment, wherein the first tubular includes a terminal end portion, the plurality of indexing components being formed in the terminal end portion.

Embodiment 11. The indexing valve system according to any prior embodiment, wherein the plurality of indexing components include an annular array of tooth components.

Embodiment 12. The indexing valve system according to any prior embodiment, wherein the second tubular includes a terminal end section, the plurality indexing members being arranged on the terminal end section.

Embodiment 13. The indexing valve system according to any prior embodiment, wherein the plurality of indexing elements project radially inwardly from the inner surface section.

Embodiment 14. The indexing valve system according to any prior embodiment, wherein the indexer projects radially outwardly of the outer surface, the indexer including a receiving portion that is selectively receptive of one of the plurality of indexing elements.

Embodiment 15. The indexing valve system according to any prior embodiment, further comprising: a travel limiter provided in the inner surface section, the travel limiter restricting axial travel of the insert relative to the first and second tubulars.

Embodiment 16. The indexing valve system according to any prior embodiment, wherein the travel limiter comprises a plurality of step features that extend radially inwardly of and annularly about the inner surface section.

Embodiment 17. A method of operating an indexing valve system comprising: shifting an insert into a passage section of a tubular; engaging an indexer on the insert with one of a plurality of indexing elements provided on the tubular; further shifting the insert to unseat a plurality of indexing members on the tubular from a plurality of indexing components on another tubular; rotating the tubular a first distance through inter-engagement of the indexer and the one of the plurality of indexing elements; biasing the tubular back toward the another tubular; re-engaging the plurality of indexing members with the plurality of indexing components; and rotating the tubular a second distance by re-engaging the plurality of indexing members with the plurality of indexing components.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An indexing valve system comprising:

a first tubular including an outer surface portion, an inner surface portion defining a passage portion, and a plurality of indexing components;

a second tubular axially aligned with the first tubular, the second tubular including an outer surface section, an inner surface section defining a passage section, and a plurality of indexing members that selectively inter-engage with the plurality of indexing components, the inner surface section including a plurality of indexing elements; and an insert arranged within, and being axially shiftable and rotationally locked relative to, the passage portion and the passage section, the insert including an outer surface supporting an indexer that selectively engages with the plurality of indexing elements to rotate the second tubular relative to the first tubular.

2. The indexing valve system according to claim 1, wherein the first tubular includes a terminal end portion, the plurality of indexing components being formed in the terminal end portion.

3. The indexing valve system according to claim 2, wherein the plurality of indexing components include an annular array of tooth components.

4. The indexing valve system according to claim 2, wherein the second tubular includes a terminal end section, the plurality indexing members being arranged on the terminal end section.

5. The indexing valve system according to claim 1, wherein the plurality of indexing elements project radially inwardly from the inner surface section.

6. The indexing valve system according to claim 5, wherein the indexer projects radially outwardly of the outer surface, the indexer including a receiving portion that is selectively receptive of one of the plurality of indexing elements.

7. The indexing valve system according to claim 5, further comprising: a travel limiter provided in the inner surface section, the travel limiter restricting axial travel of the insert relative to the first and second tubulars.

8. The indexing valve system according to claim 7, wherein the travel limiter comprises a plurality of step features that extend radially inwardly of and annularly about the inner surface section.

9. A resource exploration and recovery system comprising:

a first system;

a second system including at least one tubular extending from the first system into a formation, the second system including an indexing valve system fluidically connected to the at least one tubular, the indexing valve system comprising:

a first tubular including an outer surface portion, an inner surface portion defining a passage portion, and a plurality of indexing components;

a second tubular axially aligned with the first tubular, the second tubular including an outer surface section, an inner surface section defining a passage section, and a plurality of indexing members that selectively inter-engage with the plurality of indexing components, the inner surface section including a plurality of indexing elements; and an insert arranged within, and being axially shiftable and rotationally locked relative to, the passage portion and the passage section, the insert including an outer surface supporting an indexer that selectively engages with the plurality of indexing elements to rotate the second tubular relative to the first tubular.

10. The indexing valve system according to claim 8, wherein the first tubular includes a terminal end portion, the plurality of indexing components being formed in the terminal end portion.

11. The indexing valve system according to claim 10, wherein the plurality of indexing components include an annular array of tooth components.

12. The indexing valve system according to claim 10, wherein the second tubular includes a terminal end section, the plurality indexing members being arranged on the terminal end section.

13. The indexing valve system according to claim 9, wherein the plurality of indexing elements project radially inwardly from the inner surface section.

14. The indexing valve system according to claim 13, wherein the indexer projects radially outwardly of the outer surface, the indexer including a receiving portion that is selectively receptive of one of the plurality of indexing elements.

15. The indexing valve system according to claim 14, further comprising: a travel limiter provided in the inner surface section, the travel limiter restricting axial travel of the insert relative to the first and second tubulars.

16. The indexing valve system according to claim 15, wherein the travel limiter comprises a plurality of step features that extend radially inwardly of and annularly about the inner surface section.

17. A method of operating an indexing valve system comprising:

shifting an insert within a passage section of a tubular;

engaging an indexer on the insert with one of a plurality of indexing elements that project radially inwardly from an inner surface of the tubular into the passage section;

further shifting the insert to unseat a plurality of indexing members on the tubular from a plurality of indexing components on another tubular;

rotating the tubular a first distance through inter-engagement of the indexer and the one of the plurality of indexing elements;

biasing the tubular back toward the another tubular;

re-engaging the plurality of indexing members with the plurality of indexing components; and rotating the tubular a second distance by re-engaging the plurality of indexing members with the plurality of indexing components.

* * * * *